United States Patent [19]

Kamei et al.

[11] Patent Number: 4,579,165

[45] Date of Patent: Apr. 1, 1986

[54] MOLD FOR USE IN CONTINUOUS METAL CASTING

[75] Inventors: Futoshi Kamei; Shinichi Harada, both of Kobe; Hiroshi Soga, Akashi, all of Japan

[73] Assignee: Kabushiki Kaisha Kobe Seiko Sho, Kobe, Japan

[21] Appl. No.: 579,955

[22] Filed: Feb. 14, 1984

[30] Foreign Application Priority Data

| | | | |
|---|---|---|---|
| Feb. 14, 1983 | [JP] | Japan | 58-22599 |
| May 2, 1983 | [JP] | Japan | 58-66494[U] |
| Jun. 15, 1983 | [JP] | Japan | 58-92719[U] |
| Aug. 11, 1983 | [JP] | Japan | 58-147631 |

[51] Int. Cl.[4] ..... B22D 11/07

[52] U.S. Cl. ..... 164/418; 164/138; 164/415

[58] Field of Search ..... 164/138, 418, 415, 472, 164/443

[56] References Cited

U.S. PATENT DOCUMENTS

| | | | |
|---|---|---|---|
| 3,342,252 | 9/1967 | Wood et al. | 164/472 X |
| 3,451,465 | 6/1969 | Moritz | 164/472 X |
| 3,616,843 | 11/1971 | Newhall et al. | 164/415 X |
| 3,901,305 | 8/1975 | Balevski et al. | 164/415 |
| 4,363,352 | 12/1982 | Pryor et al. | 164/418 |
| 4,473,105 | 9/1984 | Pryor | 164/415 X |
| 4,487,251 | 12/1984 | Cahoon et al. | 164/415 X |

FOREIGN PATENT DOCUMENTS

| | | | |
|---|---|---|---|
| 2553087 | 8/1976 | Fed. Rep. of Germany | 164/443 |
| 47-33920 | 11/1972 | Japan . | |
| 0154260 | 11/1981 | Japan | 164/415 |
| 0691238 | 10/1979 | U.S.S.R. | 164/418 |

*Primary Examiner*—Francis S. Husar
*Assistant Examiner*—Steven B. Katz
*Attorney, Agent, or Firm*—Oblon, Fisher, Spivak, McClelland & Maier

[57] ABSTRACT

A porous layer consisting of sintered material containing metal powder or ceramics powder is provided as the inner surface of a mold for use in continuous metal casting, and a shielding plate is provided on the outside of this porous layer. A gas is supplied in a gap portion formed between the porous layer and the shielding plate and the gas is spouted out from the porous portions in the porous layer into the inside of the mold, thereby forming a gas film between the inner surface of the mold and the molten metal. Electromagnetic coils are interposed between a stiffening plate and sandwiching frames around the mold and hanger frames supporting them. An annular cylindrical partition wall surrounding a nozzle is provided between the mold and a tundish, and a water-cooled reflecting plate having an annular downward reflecting surface is also provided therebetween.

6 Claims, 17 Drawing Figures

MOLD FOR USE IN CONTINUOUS METAL CASTING

BACKGROUND OF THE INVENTION

1. Field of the Invention

The present invention relates to a mold for a metal casting which is used in a continuous metal casting apparatus and, more particularly, to a mold for use in a continuous metal casting having an inner surface of a porous layer which forms a gaseous film on the inner surface of the mold.

2. Description of the Prior Art

According to continuous metal casting apparatus which is conventionally used, a flux is put in the mold together with the smelting (molten steel) and is interposed therebetween, and at the same time the mold is oscillated to prevent baking of the mold, while the smelting is continuously pulled out downwardly from the mold, thereby being cast. However, there are drawbacks such as the addition of the flux adversely effecting the quality of the steel thus produced, while the construction of the apparatus becomes complicated since the mold has to be oscillated. Due to this, a method has been proposed whereby no flux is used but a porous layer is provided on the inner surface of the mold where the smelting is put in and compressed gas is always fed between the smelting and the porous layer through this porous layer of thereby interpose the gaseous film therebetween; while the smelting is pulled out downwardly of the mold for continuous metal casting.

In addition, for the above porous layer, there has been proposed, for example a porous layer which is formed in a manner such that copper powder is put in front of a copper plate and both are pressed to be closely adhered and thereafter sintered, thereby integrally forming a porous layer, wherein this layer is used as the inner wall of the mold. However, since the thermal shrinkage factor of the copper powder is larger than that of the copper plate, it is difficult to sinter both of them as an integral construction for a large sized mold. Moreover, there are many problems such as the occurrence of the cracks in the copper powder portion, occurrence of uneven porosity, and the like. Furthermore, even if they could be integrally constructed, when the copper powder portion is consumed, the copper plate portion also has to be replaced together with the copper powder portion; thus causing the running cost to be increased so as to question the realization of this method.

Also, the lower portion is uniformly formed by the soft copper powder in addition to the porous layer configuration. Due to this, since the (outer) shell of the smelting has already been hardened at the lower portion of the mold due to decrease in surface temperature, the inner surface of the abovementioned porous layer comes into contact with the shell, causing the inner surface of the lower portion of the porous layer to be worn away. Furthermore, an inconvenience occurs in that blowing of the gas becomes worse due to its abrasion.

In recent years, there has been utilized a mold in which an electromagnetic stirring apparatus applies fluid motion to the smelting in the mold to improve the semis quality.

This apparatus applies a principle of the inductive motor, i.e., electromagnetic coils to produce the rotational magnetic fields are arranged around the outer periphery of the mold and fluid motion is applied to the smelting in the mold by the rotational magnetic fields.

However, although the internal quality of the semis can be improved by the electromagnetic stirring apparatus, the improvement in surface quality is insufficient. It has been known that if the stirring speed of the smelting by the electromagnetic stirring is raised, the surface quality will be improved, but entrainment of the flux occurs, so that there is a problem in that the speed cannot be raised as desired.

In addition, in the continuous metal casting method, in order to prevent the surface of the molten metal which was molded in the water-cooled mold from being oxidation polluted by the atmosphere, direct contact with the atmosphere is conventionally prevented by scattering the flux on the surface of the molten metal or by other similar methods. The fused material of this flux enters the boundary between the water-cooled mold and the molten metal and serves as a lubricant. However, this conventional technology requires a supply of flux and the installation of the scattering apparatus, and moreover the prevention of oxidation is insufficient in the gap of the fused slag. Also, the occurrence of entrainment of the flux causes non-metalic inclusion in the semis.

Furthermore, in order to prevent oxidation pollution of the molten metal, a method has been conventionally publicly known whereby the surface of the molten metal is shut off from the outside air by inert gaseous ambience such as argon, nitrogen, etc.

Such an example is shown in Japanese Patent Kokai (Laid-Open) No. 47-33920. However, in such a conventional inert gas shut-off apparatus of this kind, it is generally difficult to effectively utilize the inert gas in spite of its large scale; a large associated gas is lost and a large amount of cost is required; the effect of preventing the pollution is insufficient in spite of the large consumption; and the secondary desirable influence cannot be expected. On the contrary, the cooling speed of the molten metal is increased and interferes and disturbs other work steps. Therefore, it is not always possible to maximize of the primary usefulness and advantage.

SUMMARY OF THE INVENTION

A porous layer consisting of sintered material containing metal powder is provided as the four inner surfaces of a mold for use in a continuous metal casting, and a shielding plate consisting of material having a good heat transfer coefficient is also provided on the outside of this porous layer. The porous layer and the shielding plate are integrally coupled and at the same time a gap portion for introducing gas is formed therebetween and compressed gas is supplied into this gap portion. The high-pressure gas spouts out from the porous portions of the porous layer into the inner surface of the mold, thereby forming a gaseous film between the molten metal and the porous layer. The outside of the shielding plate is surrounded by a stiffening plate and passageways for introducing cooling water are provided between these plates, thereby introducing the cooling water. Although the base material constituting the porous layer is metal powder such as copper powder or the like, ceramic powder is partially mixed therein for improvement in strength of the surface of the porous layer. The porous layer, shielding plate and stiffening plate are sandwiched by a pair of sandwiching frames and both sides of the sandwiching frames are further interconnected by a pair of hanger frames. An electromagnetic coil is enclosed between the stiffening plate, a pair of sandwiching frames and hanger frames. The magnetic field is produced in the molten metal by this electromagnetic coil. An expandable, annular and cylindrical partition wall is provided between a tundish and the upper surface of the mold locating in the lower portion thereof while surrounding the nozzle. A water-cooled reflecting plate having an annular reflecting surface which faces downward is attached to this partition wall.

It is an object of the present invention to provide a mold with a simple construction and good durability which can be easily manufactured and assembled and which can continuously cast the molten metal in a state with no flux and with no vibration without any inconvenience such as entrainment of the flux or the like.

Another object of the invention is to provide a mold for use in continuous metal casting having a porous layer and a sintered plate of large cross section without any limitation due to the shrinkage upon sintering.

Still another object of the invention is to provide a mold for use in a continuous metal casting which enables the use of a copper plate and a copper alloy plate having high strength as a shielding plate and makes it possible to select the sintering temperature of a sintered plate irrespective of the material of the copper plate on the back surface, and which further allows for easy repair but does not make the porosity of the sintered plate worse since only the sintered plate is used as the consuming portion of the mold.

A further object of the invention is to provide a mold for use in a continuous metal casting which can effectively remove the heat from the smelting at the upper portion of the mold and can improve abrasion resistance of the inner surface at the lower portion of the porous layer which may possibly come into contact with the stiff shell and at the same time can preferably keep the blowing of the gas from the porous layer.

A still further object of the invention is to provide a mold for use in continuous metal casting which can improve the interior quality and surface quality of an ingot by an electromagnetic stirring apparatus, thereby enabling disturbance of the oscillation marks of the surface of the semis to be prevented.

Another specific object of the invention is to provide a mold for use in a continuous metal casting which can hold the inert gaseous ambience on the molten metal and can increase the effective use of this inert gas and the concentration of the gas, thereby preventing the pollution of the molten metal, and further which can improve the heat retaining property and economical use of the heat and at the same time, can be a good influence on the characteristics of the ingot.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
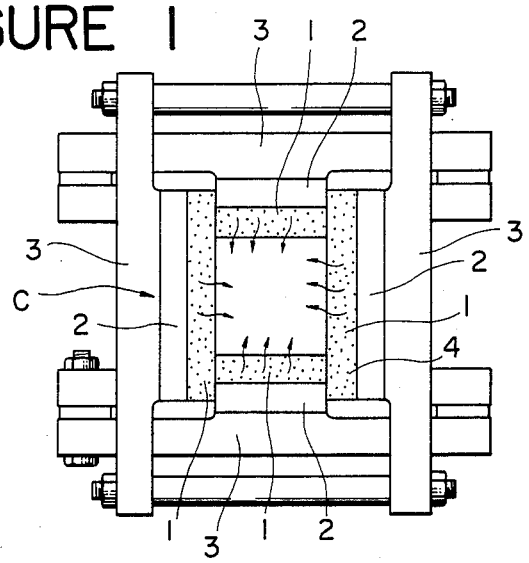
FIG. 1 is a top plan view of a mole for use in a continuous metal casting according to a first embodiment of the present invention.
Figure 2:
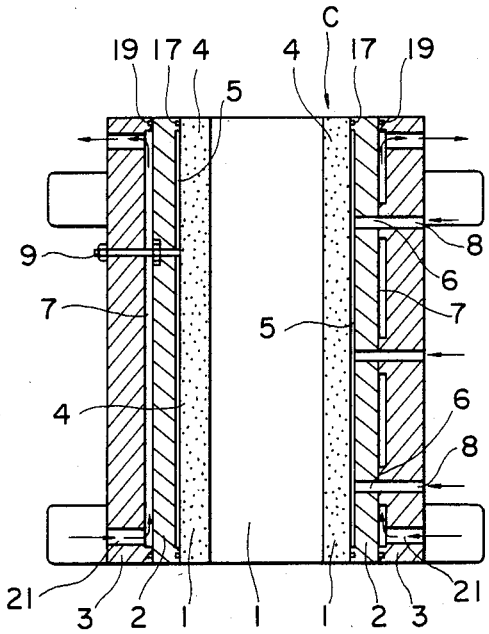
FIG. 2 is a vertical cross sectional view of FIG. 1.
Figure 3:
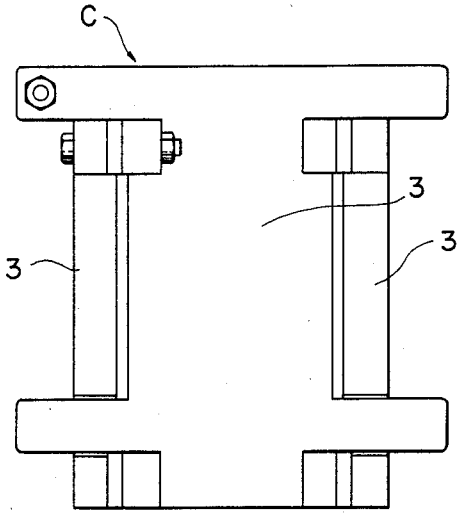
FIG. 3 is a side elevational view of FIG. 1.
Figure 5:
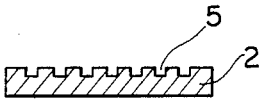
FIG. 5 is a cross sectional view of FIG. 4.
Figure 4:
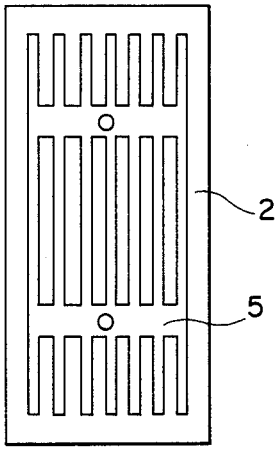
FIG. 4 is a plan view of a shielding plate.

Referring now to FIGS. 1 to 8, there is shown a first embodiment of a mold which is an almost square cylindrical mold C of the vertical type. This mold is of the type in which the peripheral four side walls are assembled. Each of the walls comprises three plates: i.e., a sintered plate 1 as a porous layer, a shielding plate 2 and a stiffening plate 3. The sintered plate 1 constituting the inner surface of the mold is formed in the manner such that metal powder of Cu, Ni, Cu-Ni, or the like, or the material of which magnetic powder of $Al_2O_3$, $Si_3O_4$, BN, etc. was mixed with that metal powder is molded like a plate and then sintered. This sintered plate has a plurality of minute air holes 4 communicating between the front surface and the back surface of the sintered plate 1 and attaching portions which will be described later are formed as required. The sintered plate 1 is the plate having a good heat transfer factor which can substantially uniformly feed gas through the air holes 4 from its back surface, i.e., from the direction of outside to the whole surface of the front surface in the inside direction; its dimensions are such as to have a sufficiently large flat shape to cover the whole inner surface of the mold; and it has a certain strength. The shielding plate 2 to be disposed on the back surface of the sintered plate 1 so as to lie thereon consists of a metal plate of Cu, Ni, Cu-Ni, etc. and covers almost the whole surface of the back surface of the sintered plate 1, thereby preventing the gas blown from the sintered plate 1 from escaping from the back surface to the outside, and at the same time receives the back pressure of the gas. On the other hand, there is provided a gap portion 5 for introducing the gas between the above plates 1 and 2 from the back surface of the sintered plate 1 to the front surface. The shielding plate 2 serves to support the sintered plate 1 by integrally coupling the sintered plate 1 by mechanical anchoring means which will be described later wherein its dimensions are such as to have a sufficiently large flat shape so as to cover the back surface of the sintered plate 1; such receiving the back pressure of the gas as described above; and at the same time the thin plate has a thickness sufficient to receive the thermal stress due to the temperature difference between the shielding plate 2 and molten steel (hereinafter, called a smelting) A to be put into the mold C. As shown in FIGS. 4 and 5, the gap portion 5 of the shielding plate 2 includes spaces with concave portions which were formed by a number of grooves at the front surface of the shielding plate 2. At the same time the shielding plate 2 is formed with gas blowing passageways 6 for introducing the high-pressure gas into the gap portion 5.

The stiffening plate 3 to be disposed on the back surface of the shielding plate 2 so as to lie thereon consists of the metal plate of steel for a general structure of SUS or the like; such covering almost the whole surface of the back surface of the shielding plate 2. The sintered plate 1 and the shielding plate 2 are reinforced so that the structural material has sufficient strength. On the other hand, there are provided passageway portions 7 for introducing cooling water between the stiffening plate 3 and the shielding plate 2, at the same time there are provided gas blowing inlets 8 for introducing the high-pressure gas into the gas blowing passageways 6 of the shielding plate 2. Similarly to the shielding plate 2, the passageway portions 7 of the stiffening plate 3 are constituted by spaces of the concave portions which were formed by a number of grooves at the front surface of the passageway portions 7. At the same time the stiffening plate 3 is formed with a cooling water passageway 21 for introducing the cooling water to the passageway portions 7.

Figure 6:
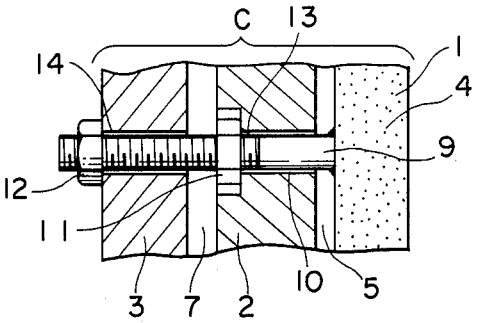
FIG. 6 is an detailed cross sectional view of a part of FIG. 1.
Figure 7:
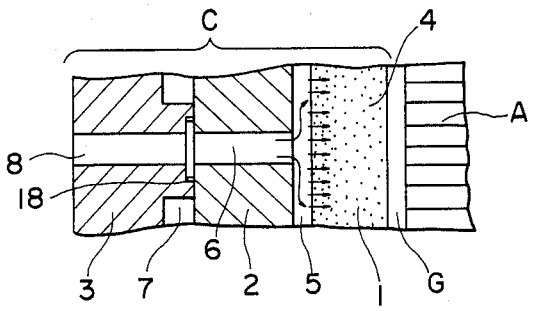
FIG. 7 is an detailed cross sectional view of a part of FIG. 1.
Figure 8:
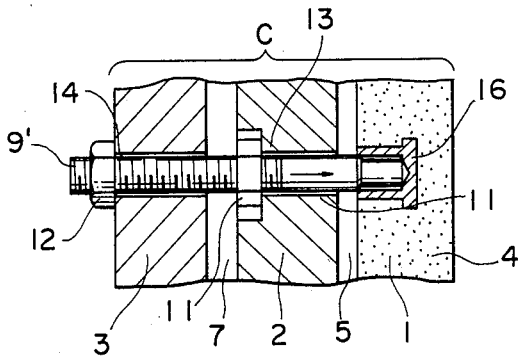
FIG. 8 is a cross sectional view showing a modification of FIG. 6.
Figure 9:
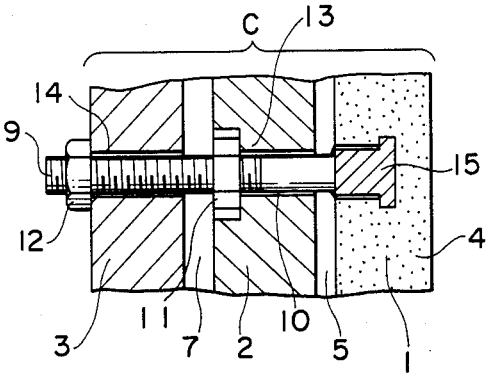
FIG. 9 is a cross sectional view showing another modification of FIG. 6.

The dimensions of the stiffening plate 3 are such as to have an enough large flat shape to cover the back surface of the shielding plate 2 and as described above, it is the thick plate having a thickness enough to reinforce the strengths of the sintered plate 1 and shielding plate 2. The stiffening plate 3 serves to integrally support the shielding plate 2 and sintered plate 1 by mechanically coupling the shielding plate 2 by the anchoring means. Shown in FIG. 6 is one example of the anchoring means comprising three plates; i.e., the sintered plate 1, shielding plate 2 and stiffening plate 3 integrally coupled. In more detail, a bolt 9 is connected by welding to the back surface of the sintered plate 1 and this bolt 9 is positioned in an anchoring hole 10 of the shielding plate 2; the shielding plate 2 being anchored by a first nut 11. Thereafter, the bolt 9 is further positioned in the anchoring hole 14 of the stiffening plate 3; and the stiffening plate 3 is fixed by a second nut 12. Screw seals 13 and 14 are respectively attached to the anchoring surfaces of the first and second nuts 11 and 12 for obtaining the air tight and liquid tight. In addition to a method of directly welding the bolt 9 to the sintered plate 1, the anchoring means may be realized by a method as shown in FIG. 9 wherein a welding stud 15 has been preliminarily embedded in the sintered plate 1 and are end of the bolt 9 is welded to stud 15. Also, as shown in FIG. 8, it may be possible to preliminarily embed a threaded stud 16 in the sintered plate 1 and thereby to screw and embed the lower end of a bolt 9' in the stud 16. With respect to the anchoring means, it may be possible to respectively and individually attach the sintered plate 1 to the shielding plate 2 and the shielding plate 2 to the stiffening plate 3; however, in any case, such have to be integrally coupled by mechanical means in the air-tight and liquid-tight state. Gas sealing members 17 and 18 and liquid sealing members 19 are interposed in the connecting portions between the outer peripheries of the sintered plate 1 and shielding plate 2 and the gas blowing passageways 6, and in the connecting portions between the outer peripheries of the shielding plate 2 and stiffening plate 3 and the cooling water passageways so as to obtain the air-tight and liquid-tight state, respectively.

Therefore, the sintered plate 1, shielding plate 2 and stiffening plate 3 which were integrally coupled by being laminated by the anchoring means are assembled as a single wall material in the mold C, so that the surface of the sintered plate 1 forms the inner wall of the mold C. At the same time the gas introducing gap portion 5 is air-tight provided between the sintered plate 1 and the shielding plate 2, while the cooling water introducing passageway portions 7 are liquid-tight provided between the shielding plate 2 and the stiffening plate 3. The high-pressure gas is supplied from an external supply source to the gap portion 5 through the gas blowing inlets 8 of the stiffening plate 3 and through the gas blowing passageways 6 of the shielding plate 2 without leaking to other portions. On the other hand, the cooling water is supplied from an external supply source to the passageway portions 7 through the cooling water passageways 8 without leaking to other portions.

Consequently, when the cooling water is supplied so as to circulatingly flow through the passageways 7, the shielding plate 2 is effectively cooled. When the high-pressure gas is continuously supplied to the gap portion 5, the gas is blown out from the front surface of the sintered plate 1 into the mold C through the plurality of air holes 4 in the sintered plate 1, thereby forming a gas layer G between the smelting A which was put into the mold C and the inner surface of the mold C. Thus, the smelting A is thermally insulated and baking of the mold C by the smelting A is prevented. In this manner, it is possible to cast while completely eliminating the sliding friction between the mold and the smelting by blowing out the gas (for example, inert gas such as argon, nitrogen, etc.) between the smelting A which was pressed and put into the mold C and the inner surface of the mold C without vibrating the mold.

The heat from the smelting in the mold, namely, the heat which was transferred through the sintered plate 1 and shielding plate 2 is cooled by the cooling water and escapes to the outside. On the other hand, this heat also escapes to the outside by means of the gaseous substance blown into the mold. The heat transfer by the cooling water is performed in accordance with the order of the smelting→gaseous substance→sintered plate 1→shielding plate 2→cooling water.

Figure 10:
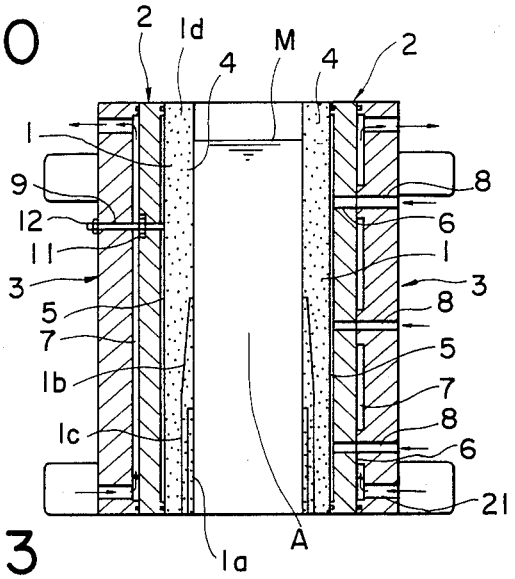
FIG. 10 is a vertical cross sectional view illustrating a second embodiment of the present invention.

A second embodiment of the present invention will now be described with reference to FIG. 10. Features of this second embodiment include an inner surface 1*a* at the lower portion of the porous layer 1 that consists of ceramic powder and the portions from an inner surface 1*b* at the central portion of the porous layer 1 to a back surface portion 1*c* of the lower inner surface 1*a* also further consists of a mixture of copper powder or copper alloy powder and ceramic powder. Therefore, since an upper inner surface 1*d* of the porous layer 1 corresponding to a meniscus M of the smelting A consists of the copper powder or copper alloy powder, it is soft although it has good thermal transfer property. On one hand, since the central inner surface 1*b* of the porous layer 1 becomes the mixture region consisting of copper and ceramics, it has intermediate thermal transfer property and hardness. In addition, the lower inner surface 1*a* of the porous layer becomes the ceramics region, so that although the thermal transfer property is relatively bad, it has an extremely high degree of hardness. It should be noted that the above-mentioned lower inner surface 1*a*, central inner surface 1*b* and back portion 1*c* also have a plurality of air holes 5.

On the other hand, the copper plate 2 as the shielding plate is overlapped on the whole back surface of the porous layer 1, respectively, and at the same time it is provided with grooves in the inner surface, thereby forming the gas passageways 8 between the porous layer 1 and the copper plate 2. Furthermore, the stiffening plate 3 is overlapped with the whole back surface of the copper plate 2, respectively, and at the same time it is formed with grooves in the inner surface, thereby forming the passageway portions 7 for the cooling water between the copper plate 2 and the stiffening plate 3.

In pulling out the molten metal by the mold for use in a continuous metal casting with the constitution as described above, although the smelting A has high temperature at the upper portion where there is the meniscus M, since the upper portion 1*d* of the porous layer 1 corresponding to the upper portion of this smelting A is formed by the copper powder or copper alloy powder having a good thermal transfer property, the heat can be effectively removed by the cooling water through the upper portion 1*d* of this porous layer and the copper plate 2. In addition, a part of the heat of the smelting A escapes to the outside by the high-pressure gas blown from the porous layer 1.

Although the shell grows on the smelting A at the lower portion of the mold due to the temperature drop and its hardness increases, since the lower inner surface 1*a* of the porous layer 1 consists of the hard ceramics powder, the lower inner surface 1*a* will not be worn away even if it comes into contact with the shell. Therefore, blowing of the high-pressure gas may be continuously preferably maintained. Although the lower inner surface 1*a* of the porous layer 1 has a relatively bad thermal transfer property, no problem results since the temperature of the shell has already decreased.

In addition, although the central inner surface 1*b* of the porous layer 1 has both an intermediate thermal transfer property and hardness since it corresponds to the mixture region of the copper powder or copper alloy powder and ceramic powder, these characteristics are preferable since the hardness and temperature of the shell corresponding to the central inner surface 1*b* are also intermediate.

In the above embodiment also, the back surface portion 1*c* as the mixture region consisting of the copper powder or copper alloy powder and ceramic powder is provided between the lower inner surface 1*a* consisting of the ceramic powder of the porous layer 1 and the portion of the porous layer 1 consisting of the copper powder or copper alloy powder; therefore, it is possible to prevent peeling-off of the lower inner surface 1*a* consisting of the ceramic powder which can otherwise be inherently easily peeled off.

Moveover, in the above embodiment, the porous layer 1 using the copper powder or the like as the base material and the copper plate 2 are separately constituted, so that there is no problem with respect to the difference in thermal shrinkage factor therebetween; no cracking occurs in the porous layer 1; the air holes 5 can be produced uniformly in the porous layer 1 and, furthermore, even if the porous layer 1 is worn away, only the porous layer 1 need be exchanged, therefore resulting in a low running cost.

A third embodiment will now be described.

Figure 11:
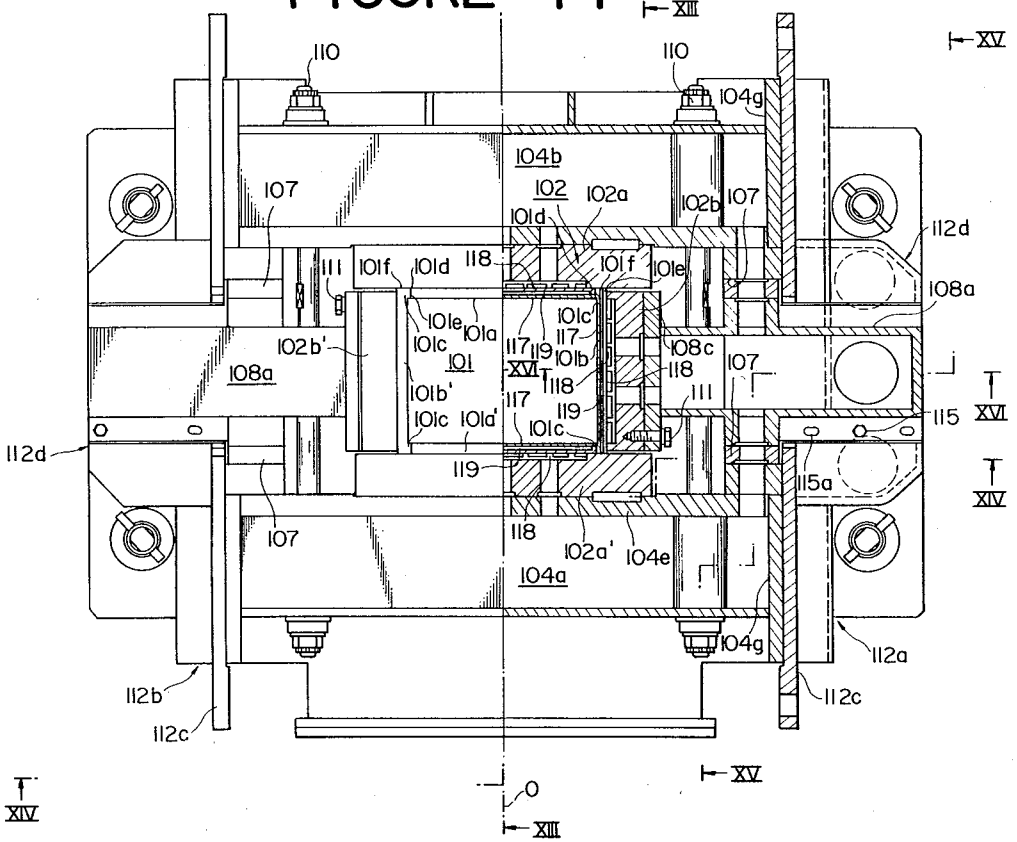
FIG. 11 is a partial cross sectional view taken along line I—I of FIG. 14 which illustrates a third embodiment of the present invention.

As shown in FIG. 11, a mold 101 comprises four flat thin inner plates 101*a*, 101*a'*, 101*b*, and 101*b'* each consisting of a non-magnetic material. In this embodiment, a pair of inner plates 101*a* and 101*a'* constitute wide inner plates, while the other pair of inner plates 101*b* and 101*b'* constitute narrow inner plates. The narrow inner plates 101*b* and 101*b'* are disposed in a manner such that side edge surface 101*d* of the other pair of wide inner plates 101*a* and 101*a'* are attached so as to abut edge surfaces 101*e* of projecting portions 101*c* which form on both sides the curved corners of the square cylindrical wall, respectively.

The inner plates 101*a*, 101*a'*, 101*b*, and 101*b'* are integrally constructed in a manner such that each inner portion is formed by a porous plate 117 of a porous layer and a shielding plate 118 consisting of material having a good thermal transfer property is provided on the outside of the porous plate 117, and wherein both plates 117 and 118 are sintered and fastened either mechanically or by brazing.

A gap portion 119 for introducing the inert gas is provided between the plates 117 and 118, so that the inert gas introduced from the side of a backup plate as the stiffening plate which will be described layer is uniformly distributed, thereby allowing the inert gas to be evenly blown into the inner surface of the mold through the blow holes in the porous plate 117.

Each of the inner plates 101*a*, 101*a'*, 101*b*, and 101*b'* is supported by respective backup plates 102*a*, 102*a'*, 102*b*, and 102*b'* as the stiffening plates each consisting of non-magnetic material.

Figure 13:
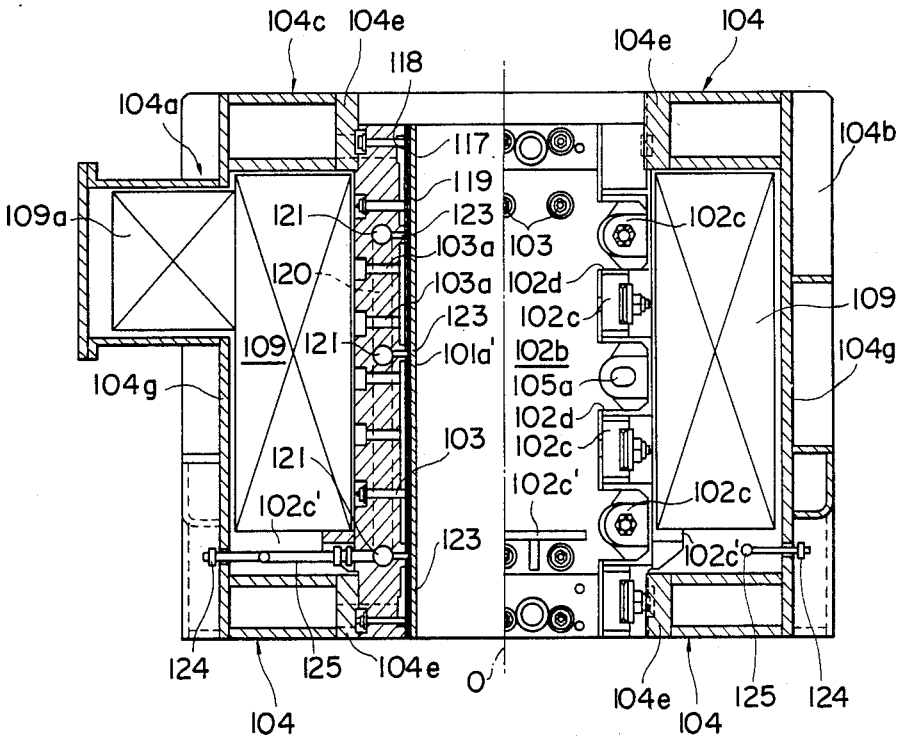
FIG. 13 is a partial cross sectional view taken along line III—III of FIG. 11.
Figure 14:
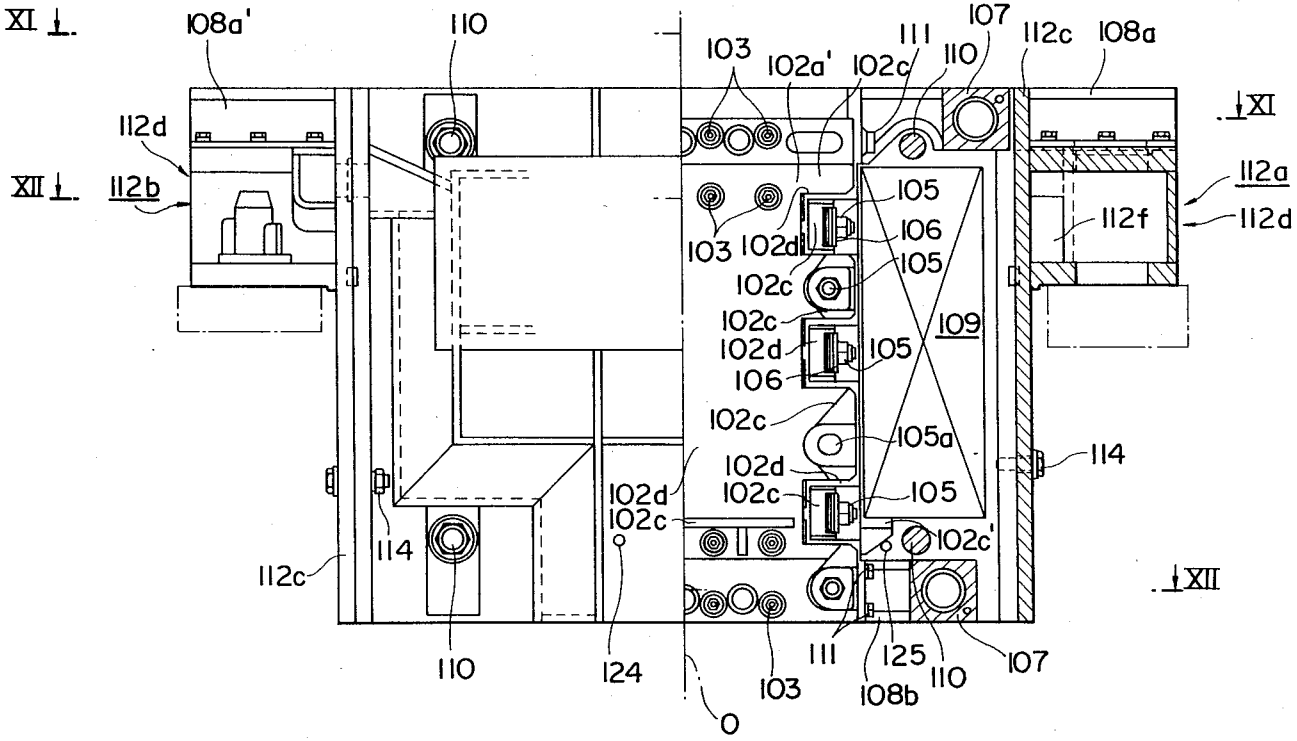
FIG. 14 is a partial cross sectional view taken along line IV—IV of FIG. 11.

As illustrated in FIGS. 13 and 14, both side portions of each backup plate are irregularly formed like a finger so as to obtain the convex and concave portions 102*c* and 102*d*. The convex portion 102*c* of one side portion of the adjacent inner plates is engaged with the concave portion 102*d* of the other side portion (clasp coupling). As clearly illustrated in FIG. 12, bolts 105 are positioned in holes 105*a* formed on the side of the convex portions 102*c* and are screwed into the concave portions 102*d*. Belleville springs 106 are operatively associated with these bolts 105, thereby allowing each backup plate to be slightly moved in each perpendicular direction. Each of the holes 105*a* has a diameter which is slightly larger than that of each bolt 105, similar to bolt holes 103*a*, thereby enabling the adjacent backup plates to be slightly moved in the perpendicular direction with each other.

By assembling the backup plates 102*a*, 102*a'*, 102*b*, and 102*b'* in the manner as described above, the edge surfaces 101*d* on both sides of the pair of wide inner plates 101*a* and 101*a'* come into pressure contact with the edge surfaces 101*e* of the projecting portions of the pair of narrow inner plates 101*b* and 101*b'*. At the same time, edge surfaces 101*f* on both sides of the pair of narrow inner plates 101*b* and 101*b'* and the back surfaces of the pair of wide inner plates 101*a* and 101*a'* come into pressure contact with the pair of wide backup plates 102*a* and 102*a'*. In addition, the back surfaces of the pair of narrow inner plates 101*b* and 101*b'* come into pressure contact with the pair of narrow backup plates 102*b* and 102*b'*.

Square cylindrical electromagnetic coils 109 are inserted in the outer peripheries of the backup plates 102 which form a square cylinder as described above. These electromagnetic coils 109 are supported from the bottom of brackets 102c' provided in the lower portion of the back surface of each backup plate. A portion 109a shown in FIGS. 12 and 13 denotes a connector portion of the electromagnetic coil 109. As shown in the drawings, the height of each electromagnetic coil 109 is less than that of each backup plate 102 and is dimensioned such that the upper and lower portions of the backup plate 102 project from the electromagnetic coil 109 in the installed state.

Figure 12:
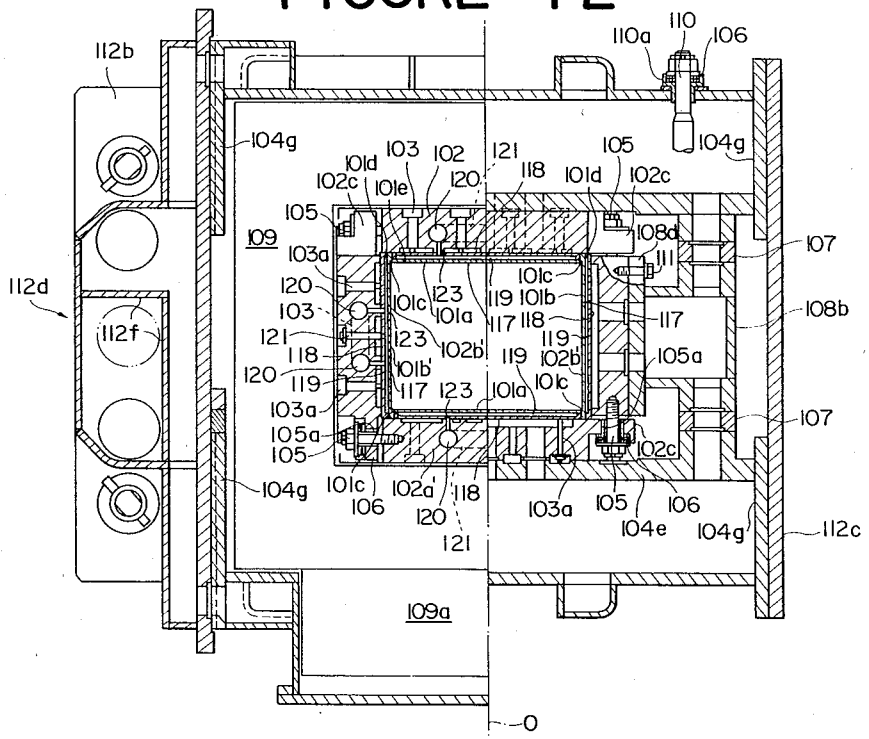
FIG. 12 is a partial cross sectional view taken along line II—II of FIG. 14.
Figure 16:
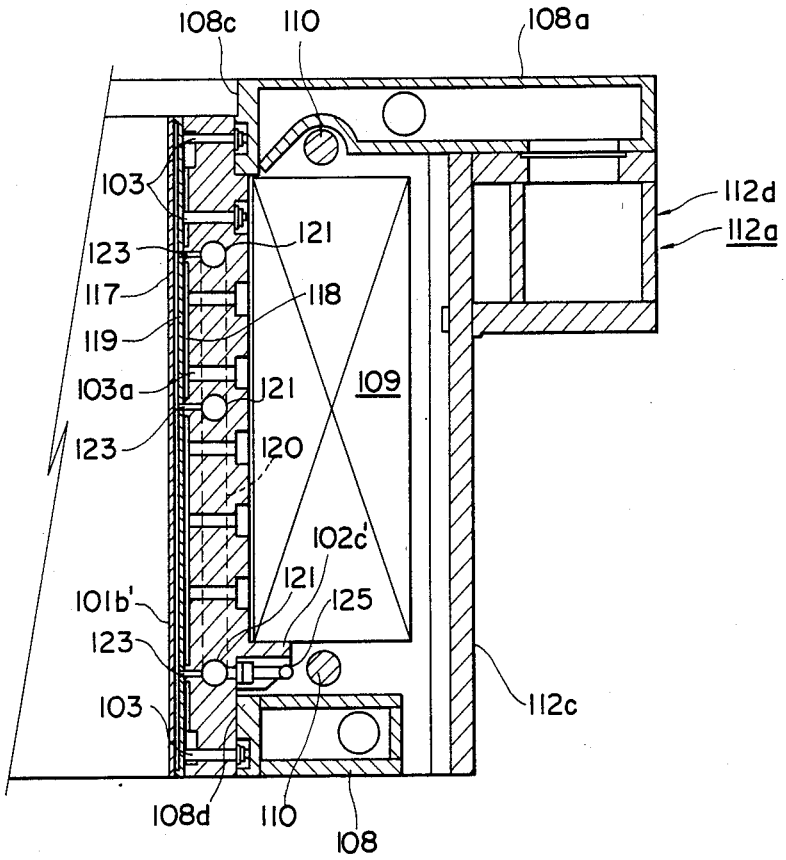
FIG. 16 is a partial cross sectional view of FIG. 11.

As shown in FIGS. 11 and 16, respectively, in the upper portions of the back surfaces of the pair of narrow backup plates 102b and 102b', an upper water passing box 108a is fixed by bolts 111, while a lower water passing box 108b is fixed by the bolts 111 in the lower portions of the back surfaces as shown in FIGS. 12 and 16.

As described above, the backup plates 102 which are provided with the electromagnetic coils 109 and the upper and lower water passing boxes 108a, 108a', 108b, and 108b' at the outer periphery are sandwiched by a pair of sandwiching frames 104a and 104b.

Figure 15:
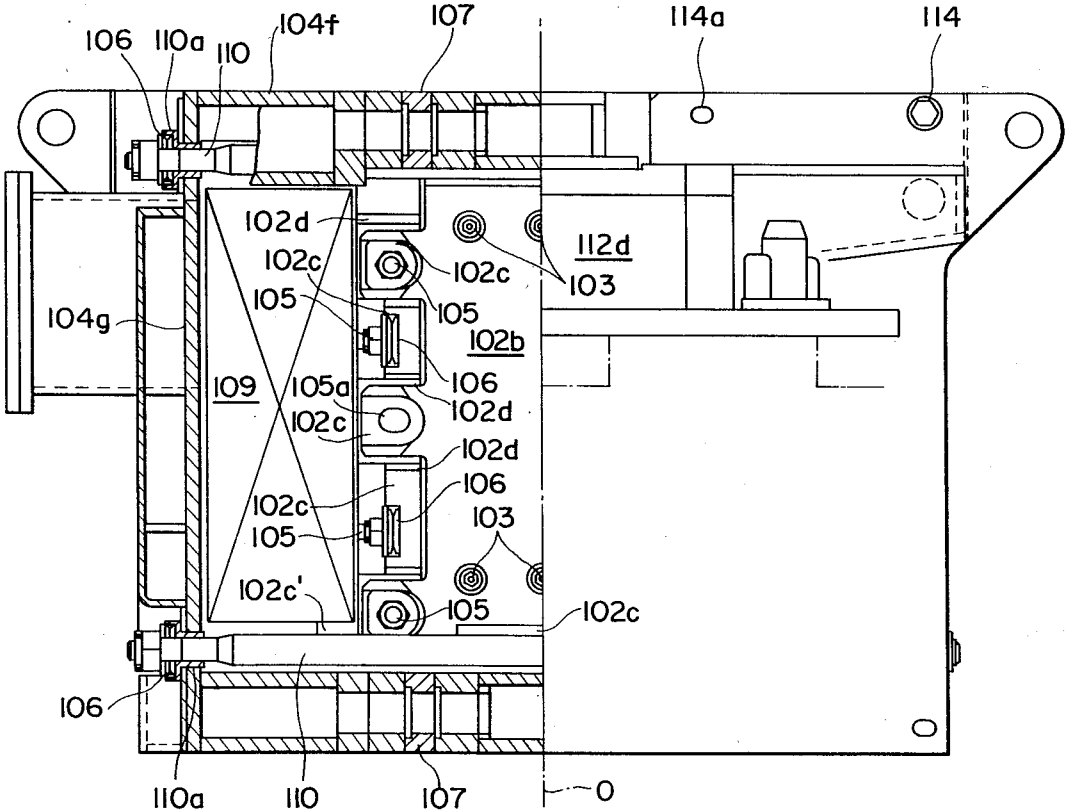
FIG. 15 is a partial cross sectional view taken along line V—V of FIG. 11.

As shown in FIG. 13, these pair of sandwiching frames 104a and 104b have box portions 104c and 104d forming the water passageways in the top and bottom portions, respectively, thereby allowing end walls 104e of the box portions 104c and 104d to come into contact with the upper and lower portions of the back surfaces of the pair of wide backup plates 102a and 102a' and at the same time are fastened by a total of four (i.e. upper, lower, right, and left) tie rods 110. As shown in FIGS. 12 and 15, the belleville springs 106 adapted to be supported by connections 110a are interposed in each tie rod 110 at its both ends. Namely, as described above, when the narrow inner plates 101b and 101b' thermally expand in the direction of width and the wide backup plates 102a and 102a' are slightly moved to the outside in the perpendicular direction, these pair of sandwiching frames 104a and 104b can be mutually expanded due to the shrinkage of the belleville springs 106.

The pair of sandwiching frames 104a and 104b which sandwich the backup plates 102 as described above are installed on a pair of hanger frames 112a and 112b. These hanger frames 112a and 112b are installed on a mold installing base (not shown) of continuous metal casting equipment.

Side walls 104g of the respective sandwiching frames 104a and 104b are fixed by bolts 114 to side walls 112c of the hanger frames 112a and 112b. This state is illustrated in FIG. 15. As described previously, this fixing is performed in a manner such that the sandwiching frames 104a and 104b can be slightly moved against the hanger frames 112a and 112b in a relationship such that the sandwiching frames 104a and 104b move when the inner wall 101 thermally expands. That is to say, bolt inserting holes 114a of the hanger frames 112a and 112b are used as longitudinal holes, and bolts 115 which were screwed and buried in the side walls 104g of the sandwiching frames through longitudinal holes 114a can be slightly moved together with the sandwiching frames 104a and 104b against the hanger frames 112a and 112b.

Each of the pair of hanger frames 112a and 112b has a water passing box section 112d in the upper portion thereof and a plurality of water passageways and water passing holes formed inside thereof; however, it is arranged in a symmetrical positional relationship with respect to a given point.

The electromagnetic coil itself is cooled by allowing the cooling water to flow in the hollow portions of the windings of the coil.

Figure 17:
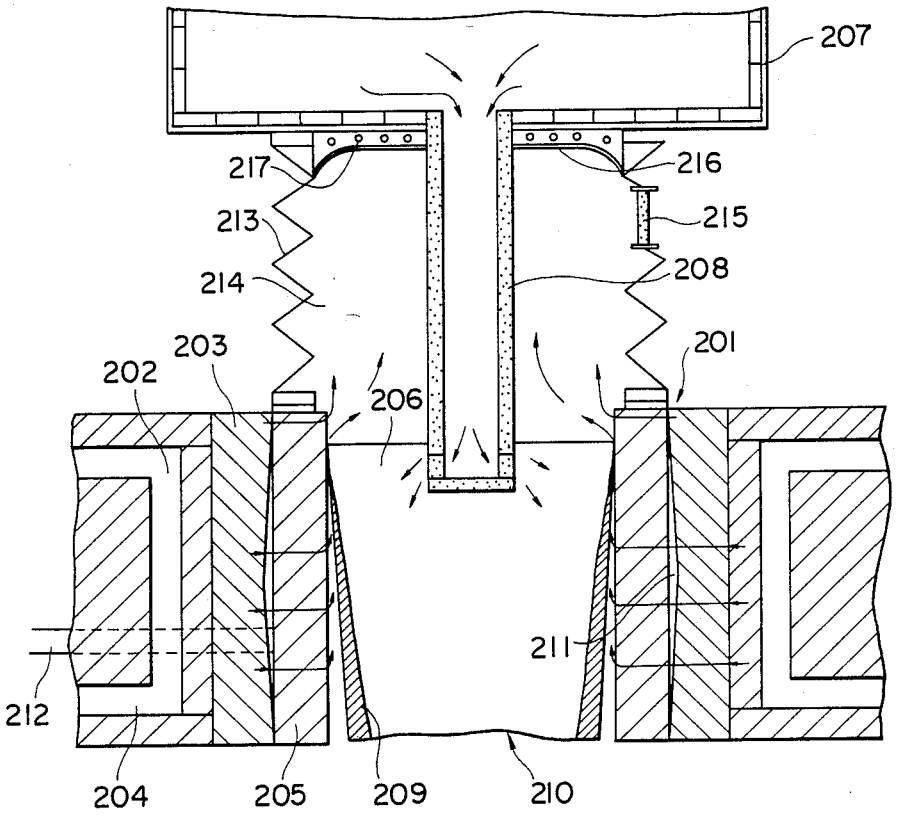
FIG. 17 is a vertical cross sectional view illustrating a fourth embodiment of the present invention.

A fourth embodiment will now be described. In the fourth embodiment shown in FIG. 17, a cylindrical composite mold 201 which opens at the top and bottom is used as the molding portion for smelting and the like in the continuous metal casting. The outer peripheral portion of this composite mold 201 is formed in a cylindrical water-cooled mold 203 made of copper having a water-cooled jacket 202. The cooling water flows through a water passageway 204 in the jacket 202. The inner peripheral portion of the composite mold 201 is formed by a porous mold 205 by a porous metal body made of copper, e.g., sintered body and is integrally coupled with the water-cooled mold 203. However, a consideration should be paid so that the escape of the heat due to the heat transfer from a molten metal 206 molded in the porous mold 205 to the cooling water is not disturbed. The molten metal is molded from a tundish 207 disposed over the mold 201 through a nozzle 208 having an outlet which opens under the liquid surface of the molten metal 206 in the mold toward the center of the inner cavity of the mold. The inner surface of the porous mold 205 comes into contact with the molten metal 206 and a meniscus ingot 210 which was formed by a solidified layer 209 in the mold by the cooled water is continuously pulled out downwardly; therefore, such is finished as the smooth surface.

An air chamber 211 constituting a thin layer is formed in the interface between the water-cooled mold 203 and the porous mold 205 with consideration of escape of the heat by the cooling water and the inert gas such as argon, nitrogen, etc. is communicated under pressure toward the air chamber 211 through an air ventilation passageway 212. This pressurized inert gas penetrates the holes in the porous mold 205 and is spouted out of the inner periphery and forms a gas film between the porous mold 205 and the ingot 210, thereby serving as a lubricant for the ingot.

An annular cylindrical partition wall 213 is provided over the upper surface of the mold 201 and the lower surface of the tundish 207 disposed over the mold 201 is mentioned before. In an example illustrated in the drawings, this annular cylindrical partition wall 213 is of the elastically expandable bellows type and the upper end thereof is attached to either surface, i.e., to the lower surface of the tundish 207 in this example, while the lower end comes into contact with the upper surface of the mold 201. The inert gas spouted out of the inner surface of the porous mold 205 flows into a space 214 formed in the partition wall 213 so that this space 214 is filled with the inert gas and maintains the inert gas ambience. Thus, the surface of the molten metal 206 is shut off from the open air, thereby preventing pollution due to the oxidation. Thereafter the inert gas leaks to the outside from the gap, for example, from the contacting surface of the partition wall 213. Reference numeral 215 denotes an inspection window which projects into the inert gas ambience. This window enables observation of the surface of the molten metal 206 in the mold. In the present invention, since it is unnecessary to scatter the flux to the surface of the molten metal 206 and cover it in order to prevent the pollution and for the lubricant to pull out the ingot, the scattering apparatus is unnecessary.

Furthermore in the present invention, in order to retain the heat of the molten metal by reducing the cooling by the heat radiation from the exposed surface of the molten metal 206, a reflecting plate 216 having an annular downwardly concaved reflecting surface in the region around the nozzle 208 in the partition wall 213 is provided on the lower surface side of the tundish 207, thereby enabling cooling water pipes 217 to be assembled for cooling. The reflecting plate 216 may be made of aluminum.

Although, in general, the molten metal to be shielded by the inert gas has disadvantage such that the cooling due to the heat radiation increases since the metal surface exposes in the gas, in the present invention, it is possible to improve the heat retaining property by reflecting almost of the radiant heat amount to be irradiated from the molten metal surface by the reflecting plate in particular. The degree of this heat amount equivalently corresponds to the case where combustion heat retaining is performed using oils by a conventional billet continuous metal casting. Thus, the present method of using the reflecting plate presents an advantageous condition in case where it is intended to obtain high temperature casting metal in the post process.

What is claimed is:

1. A mold for use in a continuous metal casting in which compressed gas is supplied between a molten metal and an inner surface of the mold to form a gas film therebetween and said molten metal is pulled out in a downward direction of the mold, thereby continuously metal casting, said mold comprising:

a porous layer consisting of sintered powder forming said inner surface of said mold, wherein said porous layer comprises:

a sintered metallic powder layer forming an upper portion of said inner surface;

a sintered layer of ceramic and metallic powder forming a central portion of said inner surface below said upper portion, said sintered layer of ceramic and metallic powder extending to a bottom of said mold, and a sintered ceramic powder layer forming a lower portion of said inner surface, said ceramic powder layer covering said ceramic and metallic powder layer at said lower portion of said inner surfaces, whereby excessive wear of said porous layer is prevented and peeling of said lower portion of said inner surface is prevented;

a shielding plate consisting of material having a desirable thermal transfer property provided on the outside of said porous layer; and mechanical means integrally coupling said porous layer and said shielding plate, said porous layer and said shielding plate forming a gap portion therebetween for introducing said gas.

2. A mold for use in a continuous metal casting according to claim 1, further comprising a stiffening plate consisting of structural material and integrally coupled on a back side of said shielding plate.

3. A mold for use in a continuous metal casting according to claim 2, said shielding plate and said stiffening plate forming a passageway portion for introducing a cooling fluid thereinto.

4. A mold for use in a continuous metal casting according to claim 1 or 3, wherein said porous layer is integrally formed using a powder as the base material.

5. A mold for use in a continuous metal casting according to claim 4, wherein said powder further comprises a copper powder.

6. A mold for use in a continuous casting according to claim 4, wherein said powder further comprises a copper alloy powder.

* * * * *